United States Patent [19]

Misumi et al.

[11] Patent Number: 4,713,576

[45] Date of Patent: Dec. 15, 1987

[54] COLOR PICTURE TUBE WITH SHADOW MASK

[75] Inventors: Akira Misumi; Ryoji Hirai, both of Mobara; Rikizo Watanabe, Yasuki, all of Japan

[73] Assignees: Hitachi, Ltd.; Hitachi Metals, Ltd., both of Tokyo, Japan

[21] Appl. No.: 852,228

[22] Filed: Apr. 15, 1986

[30] Foreign Application Priority Data

Apr. 24, 1985 [JP] Japan ..... 60-86439

[51] Int. Cl.[4] ..... H01J 29/07; H01B 1/02

[52] U.S. Cl. ..... 313/402; 252/513; 252/519

[58] Field of Search ..... 313/402, 407, 408; 445/36, 47; 252/513, 519

[56] References Cited

FOREIGN PATENT DOCUMENTS

| | | | |
|---|---|---|---|
| 0175370 | 3/1986 | European Pat. Off. | 313/407 |
| 2350366 | 4/1975 | Fed. Rep. of Germany | 313/402 |
| 59-59861 | 4/1984 | Japan . | |

*Primary Examiner*—Leo H. Boudreau
*Assistant Examiner*—Sandra L. O'Shea
*Attorney, Agent, or Firm*—Charles E. Pfund

[57] ABSTRACT

A color picture tube includes a shadow mask of a precipitation strengthening Fe-Ni alloy. The alloy contains Fe-Ni as a major constituent and has at least one additive element. The alloy has a precipitation strengthening phase of $Ni_xX_y$ (wherein X is at least one element selected from the group consisting of Al, Ti, Nb, Ta and Zr; x is 2 to 4; and y is 0.05 to 1.5) and an average thermal expansion coefficient of not more than $6\times10^{-6}$/° C. in a temperature range of 20° C. to 100° C.

9 Claims, 7 Drawing Figures

COLOR PICTURE TUBE WITH SHADOW MASK

BACKGROUND OF THE INVENTION

The present invention relates to a color picture tube with a shadow mask.

A shadow mask for a color picture tube has a large number of regularly aligned apertures. The number of electrons passing through the apertures is about ⅓ or less the total number of electrons. The remaining electrons bombard and heat the shadow mask, resulting in thermal expansion of the shadow mask and degradation of color purity.

In a conventional color picture tube with a shadow mask, beam mislanding caused by thermal expansion must be limited. For this reason, improvements in the shadow mask structure itself, the assembly of the shadow mask and its support, and the shadow mask material have all been explored. However, no substantial solutions have been found so far.

SUMMARY OF THE INVENTION

It is, therefore, a principal object of the present invention to provide a shadow mask with higher mechanical strength than conventional masks, a low thermal expansion coefficient, and a simple fabrication process, resulting in a high-performance color picture tube with high color purity.

In order to achieve the above object of the present invention, there is provided a color picture tube having a shadow mask of a precipitation strengthening invar alloy, the alloy containing Fe-Ni as a major constituent and additive elements and having precipitation strengthening phases of $Ni_xX_y$ (wherein X is at least one of Al, Ti, Nb, Ta, and Zr; x is 2 to 4; and y is 0.5 to 1.5) after a precipitation strengthening treatment and an average thermal expansion coefficient of not more than $6\times10^{-6}$/°C. in the range of 20° C. to 100° C.

A typical example of a conventional shadow mask material is mild steel. Mild steel can be easily formed by pressing, but its thermal expansion coefficient is as large as about $12\times10^{-6}$/°C. When a mild steel shadow mask is bombarded by electrons, it thermally expands to degrade color purity. Another example of a conventional shadow mask material is an Fe-Ni invar alloy with a small thermal expansion coefficient for decreasing deformation of the shadow mask due to thermal expansion, as described in Japanese Patent Prepublication No. 59-59861.

Although a conventional Fe-Ni alloy shadow mask has a small thermal expansion coefficient, it also has low mechanical strength. During the fabrication of shadow masks and color picture tubes and their assembly and operation, the shadow masks often deform, thus degrading color purity.

DESCRIPTION OF THE PREFERRED EMBODIMENTS

Figure 1:
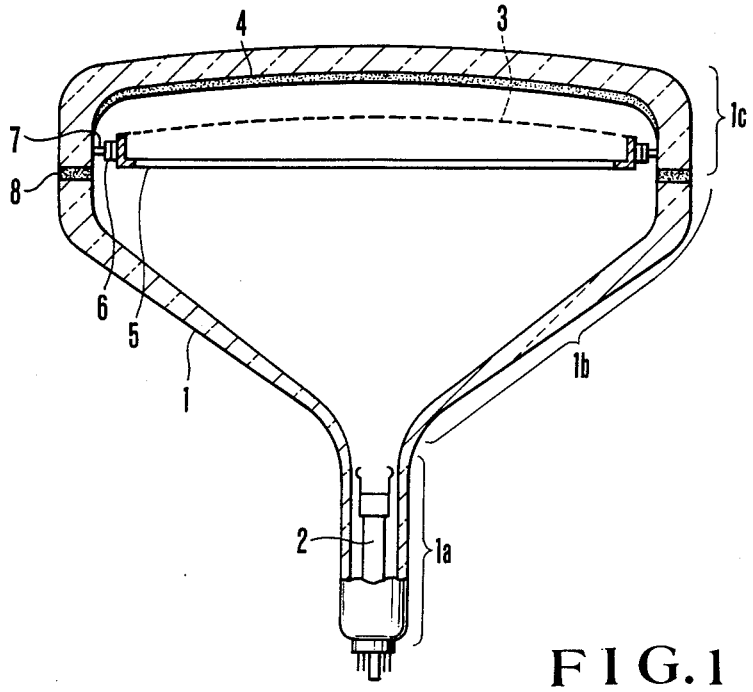
FIG. 1 is a sectional view of a color picture tube with a shadow mask according to an embodiment of the present invention.
Figure 2:
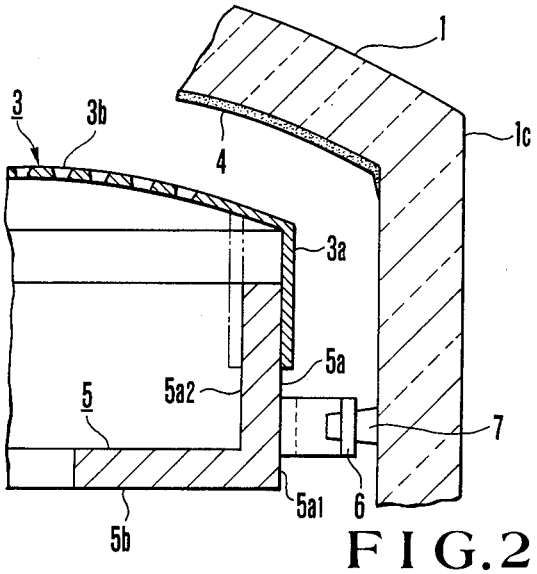
FIG. 2 is an enlarged sectional view showing a main part of the shadow mask in FIG. 1.
Figure 3:
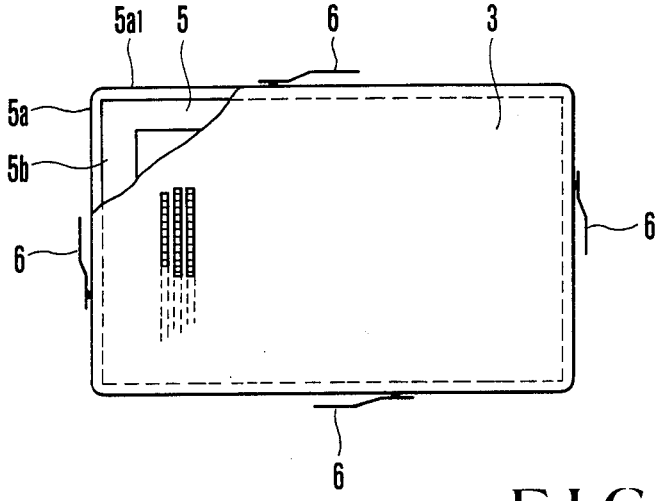
FIG. 3 is a partially cutaway front view of the color picture tube in FIG. 1 when viewed from the phosphor screen side.

FIG. 1 shows a color picture tube according to an embodiment of the present invention. Referring to FIG. 1, reference numeral 1 denotes a bulb; 2, an electron gun; and 3, a tray-like shadow mask. The shadow mask 3 consists of a precipitation strengthening Fe-Ni alloy of a composition (to be described later) according to the present invention. Reference numeral 4 denotes a phosphor screen; 5, a mask support for supporting the shadow mask 3; 6, a plurality of support members mounted on the outer surface of the mask support 5; and 7, a panel pin extending from the bulb 1. The free end of the support 6 is engaged with the corresponding panel pin 7. FIGS. 2 and 3 show the detailed structure of the shadow mask 3 and its peripheral structure. Referring to FIGS. 2 and 3, a skirt **3*a* of the shadow mask 3 is fixed by welding or the like to an outer side surface 5*a*1 of a vertical wall 5*a* of the mask support 5. One end of the support member 6 is fixed to the outer side surface 5*a*1, and the free end of the member 6 is engaged with the corresponding panel pin 7. Reference numeral 3*b* denotes mask apertures. The shadow mask 3 may be fixed on an inner surface 5*a*2 of the mask support 5, as indicated by the alternate long and short dashed line. Reference numeral 5*b* denotes a flange of the mask support 5** which is bent along a tube axis (not shown).

Figure 4:
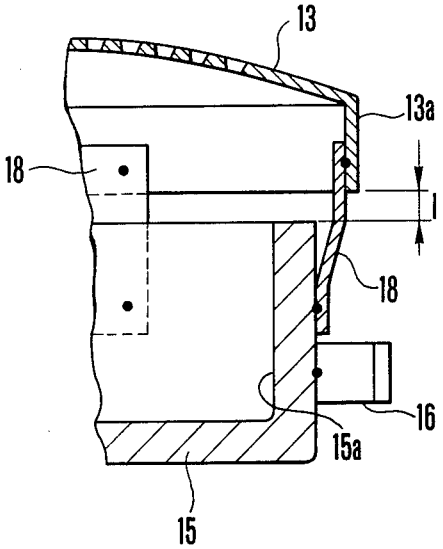
FIG. 4 is an enlarged sectional view showing a main part of a shadow mask for a color picture tube according to another embodiment of the present invention.

FIG. 4 shows another embodiment of a color picture tube employing the present invention. In this embodiment, the color picture tube has a shadow mask 13 of a precipitation strengthening Fe-Ni alloy, just as the embodiment in FIG. 1. The shadow mask 13 is not directly fixed to a vertical wall **15*a* of a mask support 15 but is vertically spaced apart therefrom by a distance 1. The shadow mask 13 is connected to the vertical wall 15*a* through an intermediate member 18. With this connection method, deformation of the shadow mask 13 by the mask support 15 can be reduced even if the mask support 15 and the shadow mask 13** consist of materials with different thermal expansion coefficients.

Figure 5:
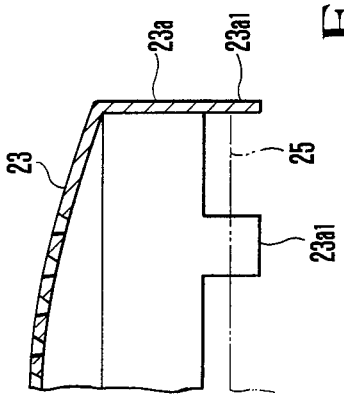
FIG. 5 is an enlarged sectional view showing a main part of a shadow mask for a color picture tube according to still another embodiment of the present invention.

FIG. 5 shows still another embodiment of a color picture tube employing the present invention. Like the previous embodiments, the shadow mask of this embodiment consists of a shadow mask 23 of a precipitation strengthening Fe-Ni alloy. In this embodiment, however, a plurality of projections **23*a*1 are formed at the open end of a skirt 23*a* of the shadow mask 23. The shadow mask 23 is fixed to a mask support 25 through the projections 23*a*1**. With this structure, the mask deformation described above can be prevented.

Figure 6:
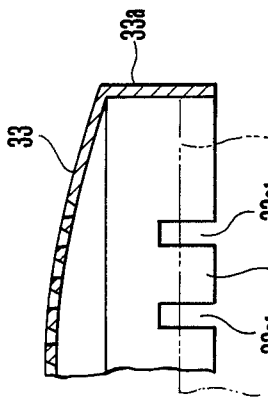
FIG. 6 is an enlarged sectional view showing a main part of a shadow mask for a color picture tube according to still another embodiment of the present invention.

FIG. 6 shows still another embodiment of a color picture tube employing the present invention. Like the previous embodiments, the picture tube has a shadow mask 33 of a precipitation strengthening Fe-Ni alloy.

However, in this embodiment, notches 33a1 are formed in a skirt 33a of the shadow mask 33 from the open end side. The shadow mask 33 is fixed to a mask support 35 through tongues 33a2 defined by the notches 33a1. With this structure, even if the shadow mask 33 and the mask support 35 are made of the same material, mask deformation can be prevented. Furthermore, as described in Japanese Utility Model Publication No. 55-52610, a mechanical strength adjusting means may be provided in a region extending from the skirt of the shadow mask to a peripheral flat portion around the recessed surface portions.

Materials used in the shadow masks in the above-mentioned color picture tubes will be described below. For a better understanding, the process from shadow mask fabrication to color picture tube fabrication will be briefly described.

A large number of mask apertures are formed in a plate by etching. The plate shape greatly influences a mask aperture shape, dimensional uniformity, and workability. Before being formed by pressing, the plate is subjected to high-temperature heat treatment and levelling to improve pressing properties. In other words, the 0.2% yield stress of the plate is reduced to be compatible with the pressing process. The high-temperature heat treatment is performed at a temperature of about 800° C. or higher. The pressed shadow mask is washed and is then subjected to a blackening treatment. This forms an oxide film on the surface of the shadow mask, giving it rustproof properties. The shadow mask is fixed to a mask support, and the required number of support members are fixed to the mask support to prepare a shadow mask assembly. A thin film containing phosphors and a photosensitive binder is formed on the inner surface of a panel. The shadow mask assembly is temporarily fixed inside the panel. The thin film is irradiated with beams from a light source through the shadow mask, and the shadow mask assembly is removed. The inner surface of the panel is developed, and phosphor dots (or stripes) are formed on the panel in a predetermined pattern to constitute a phosphor screen. A cycle of coating, exposure, and development is performed for each phosphor color. A black matrix film may also be formed if needed. A metallized layer is then formed on the phosphor pattern, i.e., the phosphor screen having the black matrix film thereon. The metallized layer normally consists of a deposited aluminum film. The panel portion with the metallized layer is subjected to a heat treatment (about 350° C. to 450° C.), i.e., the so-called "panel bake". A funnel portion with a neck is bonded by frit glass to the panel portion while the shadow mask assembly used in the previous exposure is mounted in the panel portion. Subsequently, an electron gun is inserted in the neck, and the bulb is evacuated at a temperature of 300° C. to 400° C., thereby preparing a color picture tube.

As is apparent from the previous description, in the color picture tube, the shadow mask is used as a mask during exposure of the phosphor screen. In the finished color picture tube, the same shadow mask is used as an electron beam selecting means. The mask aperture positions during exposure must be the same as those in the finished tube. For this reason, the shadow mask must not be thermally deformed during fabrication or operation. The mechanical strength of the shadow mask is thus an extremely important factor. In a terminal color picture tube with a high resolution, for example, a dot pitch is small, and beam mislanding due to doming entails a decisive drawback.

From this viewpoint, the material used in the shadow mask of the present invention must satisfy the following conditions:

(1) It must have a thermal expansion coefficient of $6\times10^{-6}$/°C. or less, i.e., about half the coefficient of a mild steel plate as a conventional shadow mask material.

(2) It must be capable of being formed by press working with equal or greater ease than a conventional Invar alloy shadow mask.

(3) It must have a mechanical strength significantly higher than that of the conventional Invar alloy during use of the color picture tube.

No material which satisfies all these conditions can be found in the prior art patents and techniques mentioned above.

The present inventors have made extensive studies on a material which simultaneously satisfies these three conditions and have found an Fe-Ni alloy prepared by converting a low-expansion alloy to a precipitation strengthening alloy. The low-expansion alloy is softened by a high-temperature heat treatment before pressing of the shadow mask. The heat-treated alloy is strengthened by precipitation strengthening such as a low-temperature treatment like blackening or stabilizing. In the subsequent fabrication process and actual operation of the color picture tube, degradation of strength due to changes in ambient temperature does not occur.

A shadow mask used in the color picture tube of the present invention comprises an alloy containing Fe-Ni (its total content is not less than 80 wt %) and has at least one additive element selected from the group consisting of Al, Ti, Nb, Ta, Zr, Co, Si, Mn, W, Cr and Mo. A precipitation strengthening phase after the precipitation strengthening treatment is $Ni_xX_y$ (wherein X is at least one element selected from the group consisting of Al, Ti, Nb, Ta and Zr; x is 2 to 4; and y is 0.5 to 1.5). The precipitation strengthening phase is well compatible with the austenite phase of a matrix of the Fe-Ni alloy and precipitation can easily occur. The degree of precipitation strengthening is also large. By combining the composition of the Invar or superinvar with the composition of the precipitation strengthening phase, an average thermal expansion coefficient of $6\times10^{-6}$/°C. or less and preferably of $4\times10^{-6}$/°C. or less can be obtained, and the mechanical strength can be greatly improved.

The elements of the shadow mask material used in the color picture tube of the present invention have the following effects.

Ni together with Fe constitutes a matrix composition. The content of Ni is 30 to 50 wt % and preferably 35 to 45 wt % to minimize the thermal expansion coefficient of the alloy.

Ti, Al, Nb, Ta or Zr can combine with some of the Ni atoms to precipitate an $Ni_xX_y$ intermetallic compound to increase the alloy strength. Among these elements, Ti has the highest precipitation strengthening effect. The shadow mask alloy in the color picture tube of the present invention preferably contains 1% or more of Ti. However, when the content of Ti exceeds 5%, the thermal expansion coefficient of the alloy is excessively increased, and degrading press workability. A proper amount of Al, Nb, Ta and Zr can be added singly or as a substitute for some of the Ti atoms to precipitate and strengthen the alloy. However, if the Al content exceeds 4%, the Nb or Ta content exceeds 10%, or the Zr content exceeds 1%, the resultant alloy will have poor press workability.

Cr, Mo and W decrease the solid solubility of the precipitating strengthening elements such as Ti, Al, Nb, Ta and Zr in the shadow mask material of the color picture tube and accelerate precipitation of an $Ni_xX_y$ intermetallic compound. Cr, Mo and W can be added in small amounts. However, if the content of Cr, Mo or W exceeds 10%, the thermal expansion coefficient of the resultant alloy will be excessively high.

Especially, Cr serves to decrease yield stress of the solid solution and to improve press forming properties of the resultant alloy.

Si and Mn serve as a deoxidant and a desulfurizer and can be added in small amounts. However, if the Si content exceeds 1% or the Mn content exceeds 2%, the thermal expansion coefficient of the resultant alloy will be undesirably high.

If the total content of alloy elements (Ti, Al, Nb, Ta, Zr, Cr, Mo, W, Si and Mn) excluding Ni exceeds 10%, the thermal expansion coefficient of the resultant alloy will be undesirably high.

Co serves to decrease a thermal expansion coefficient of the resultant alloy when 10% or less of Co is substituted with an equal amount of Ni. However, when the Co content exceeds 10%, the thermal expansion coefficient of the resultant alloy is no longer reduced, and the cost of the resultant alloy significantly increases.

Table 1 shows the alloy compositions and the properties of alloys after precipitation strengthening treatment. All samples of the present invention have higher 0.2% yield stress and hardness than comparative Invar alloy (sample 27) and smaller average thermal expansion coefficients than mild steel (sample 28).

TABLE 1

| | Element To Be Added (wt %) | | | | | | After Precipitation Strengthening Treatment | | Thermal Expansion |
|---|---|---|---|---|---|---|---|---|---|
| Sample | Ni | Co | Ti | Al | Nb | Others | 0.2% Yield Stress (kgf/mm²) | Hardness (Hv) | Coefficient (20–100° C.) (× $10^{-6}$/°C.) |
| 1 | 38.9 | | 1.6 | | | | 45.3 | 201 | 3.05 |
| 2 | 40.8 | | 2.4 | | | | 56.9 | 223 | 3.28 |
| 3 | 42.7 | | 4.0 | | | | 68.3 | 264 | 3.96 |
| 4 | 40.2 | | 2.5 | 1.4 | | | 58.2 | 231 | 3.48 |
| 5 | 40.8 | | 1.7 | 0.2 | | | 48.7 | 206 | 2.92 |
| 6 | 40.4 | | | | 4.0 | | 42.5 | 194 | 3.37 |
| 7 | 41.0 | | | 2.3 | | | 41.4 | 185 | 3.64 |
| 8 | 39.5 | | | | 7.1 | | 47.6 | 205 | 5.25 |
| 9 | 39.8 | | 1.9 | | | Cr 2.1 | 48.7 | 209 | 4.25 |
| 10 | 41.4 | | 2.4 | 0.8 | | Mo 2.4 | 55.5 | 227 | 4.50 |
| 11 | 40.4 | | 0.9 | | 2.3 | | 42.5 | 194 | 3.18 |
| 12 | 40.5 | | 0.7 | 0.2 | 2.0 | | 35.9 | 168 | 3.09 |
| 13 | 41.7 | | 2.2 | | | Ta 2.3 | 61.8 | 234 | 4.42 |
| 14 | 39.3 | | 1.6 | | | Zr 0.3 | 48.0 | 207 | 3.29 |
| 15 | 37.1 | 3.6 | 2.4 | | | | 62.7 | 238 | 2.76 |
| 16 | 36.9 | 3.5 | | | 3.8 | | 44.8 | 194 | 2.89 |
| 17 | 37.4 | 3.7 | | 2.4 | | | 45.4 | 196 | 3.02 |
| 18 | 38.3 | 3.7 | 1.7 | 0.2 | | | 57.1 | 217 | 2.77 |
| 19 | 36.8 | 3.2 | 2.0 | | | Cr 1.8 | 50.3 | 213 | 3.84 |
| 20 | 39.7 | | 1.7 | 0.2 | | Cr 1.0 | 45.6 | 201 | 3.30 |
| 21 | 40.4 | | 1.7 | 0.2 | | Cr 1.9 | 43.3 | 202 | 3.90 |
| 22 | 39.6 | | 1.8 | 0.2 | | Cr 3.0 | 41.0 | 187 | 4.66 |
| 23 | 39.9 | | 1.8 | 0.3 | | Cr 2.0 | 53.1 | 276 | 3.73 |
| 24 | 39.8 | | 1.6 | 0.3 | | Cr 2.0 | 60.0 | 266 | 3.86 |
| 25 | 45 | | 3.0 | 0.5 | | Cr 4.0 Si 0.5 Mn 1.0 | 85.0 | 340 | 5.80 |
| 26 | 35 | | 1.0 | 0.1 | | Cr 1.0 Si 0.1 Mn 0.1 | 38.0 | 182 | 4.95 |
| Comparative Material | | | | | | | | | |
| 27 | 36.5 | | | | | Invar | 25.8 | 128 | 0.88 |
| 28 | (Mild Steel) | | | | | | 11.4 | 92 | 12.0 |

The present invention will be described in detail by way of examples.

EXAMPLE 1

Using compositions of samples 1 to 6, 0.13-mm thick plates were etched to form shadow mask plates with apertures. The apertures had a pitch of 0.40 mm and a diameter of 0.090 mm. The apertured shadow mask plates were annealed in a gas mixture of nitrogen and hydrogen at a temperature of 1,000° C. for one hour. Annealing also served as a solid solution treatment. The six plates were pressed to provide eighteen 15" shadow masks, i.e., three 15" shadow masks per plate. These shadow masks were subjected to a blacking treatment, which also served as the precipitation strengthening treatment, at a temperature of 650° C. for 0.5 hour to prepare 18 shadow mask assemblies like the one shown in FIG. 4. One stainless steel plate having dimensions of 0.15 mm × 30 mm × 18 mm was used to constitute the short side of an intermediate member, and two stainless steel plates of the same dimensions were used to constitute the long side thereof. The mask support comprised a 1.6-mm thick mild steel plate. In this case, each shadow mask was connected to the support through the intermediate member under the condition $l=0$.

Color picture tubes were prepared according to a known method using these shadow mask assemblies. These color picture tubes were fixed in corresponding wooden boxes such that the outer surfaces of the panels faced upward. The resultant assemblies were dropped from a height of 30 cm to test the mechanical strength of the shadow masks. No deformation of the shadow masks occurred in the color picture tubes of Example 1, unlike the conventional color picture tubes with the specifications given below:

| Specification | Shadow Mask | Mask Support | Assembly Structure |
|---|---|---|---|
| 1 | 0.18-mm mild steel | 1.6-mm mild steel | FIG. 1 of this invention |
| 2 | 0.13-mm invar | 1.6-mm mild steel | FIG. 1 of this invention |

A wrinkle-like permanent deformation was left in the invar shadow mask of specification 2 and caused a large defect on the screen of the color picture tube. Deformation of the mild steel shadow mask of specification 1 was substantially the same as that of Example 1. However, beam mislanding caused by doming of the shadow mask of mild steel did not fall within a desired range, while beam mislanding in the shadow masks of the present invention was little. The beam mislanding index of each shadow mask of the present invention was reduced to 50 or less as compared with 100 of conventional specification 1, thus providing excellent properties. The shadow mask of specification 2 had a beam mislanding index of 30 or less with respect to 100 of specification 1, but suffered large shadow mask deformation. Therefore, the shadow masks of the present invention both prevent shadow mask deformation and reduce beam mislanding.

Figure 7:
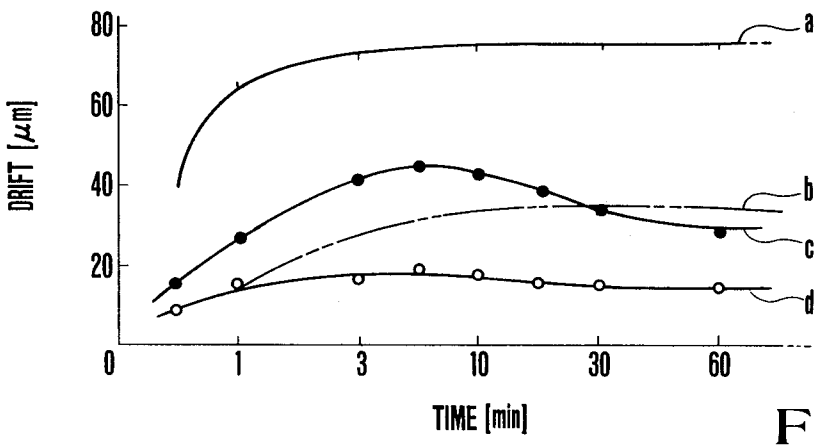
FIG. 7 is a graph showing doming characteristics, i.e., drift as a function of time, in shadow masks of the present invention and conventional shadow masks.

FIG. 7 shows doming characteristics, i.e., drift of the center of the shadow mask as a function of time, for the shadow masks of the present invention and conventional shadow masks. Referring to FIG. 7, a characteristic curve a shows the doming characteristics when the mild steel shadow mask of specification 1 is used. A characteristic curve b shows the doming characteristics when the conventional Invar alloy shadow mask of sample 27 is used. A characteristic curve c shows the doming characteristics when a sample containing 39.8 wt % of Ni, 1.7 wt % of Ti, 0.3 wt % of Al, and 2.0 wt % of Cr, which is within the range of the invention is used without the precipitation strengthening treatment. A characteristic curve d shows the doming characteristics when the sample of the curve c is subjected to the precipitation strengthening treatment at a temperature of 700° C. As is apparent from these characteristic curves, the shadow mask of the present invention has good doming characteristics.

EXAMPLE 2

Using the same compositions as in Example 1, tongues were formed at centers of the respective sides, as shown in FIG. 5. The tongues on the short sides had a width of 18 mm and a length of 5.5 mm. The tongues on the long sides had a width of 14 mm and a length of 5.5 mm. The skirt was directly coupled to the support at the corners thereof. The comparative examples are the same as specifications 1 and 2 in Example 1.

The resultant shadow masks were tested for shadow mask deformation and beam mislanding. The same results as in Example 1 were obtained. The samples having the compositions described above, and subjected to the heat treatment before pressing, can be pressed with the same or greater ease than the conventional Invar material. The mechanical strength of the finished shadow masks after the precipitation strengthening treatment is much greater than that of the conventional Invar material. The average thermal expansion coefficient in the temperature range of 20° C. to 100° C. is $6\times10^{-6}$/°C. or less, which is less than half the coefficient of mild steel. Therefore, the beam mislanding amount can be decreased to ½ or less that of a conventional bulb. When the thermal expansion coefficient exceeds $6\times10^{-6}$/°C., the beam mislanding amount exceeds a predetermined range.

Precipitation strengthening can be performed preferably in the temperature range of 400° C. to 700° C. by the heat treatment after the solid solution treatment at a preferable temperature of 850° C. or more and pressing, or by the blackening or stabilizing treatment as the fabrication process of the color picture tube.

The Al-containing composition of sample 7 has the best etching properties.

In Examples 1 and 2, the shadow mask and the mask support are made of different metals. However, when the shadow mask and the mask support comprise the precipitation strengthening Fe-Ni alloy of one of the compositions of the present invention, thermal deformation can be further decreased, and color purity can be further improved. The mask support members can also be constituted by thin plates so as to provide a structure as described in Japanese Patent Publication No. 59-13824.

According to the present invention as described above, there is provided a color picture tube whose shadow mask mechanical strength can be controlled before and after pressing. The mechanical strength of the shadow mask during the fabrication and operation of the color picture tube can be increased, and its deformation can be prevented. In addition, the shadow mask has a low thermal expansion coefficient. Therefore, beam mislanding amount can be reduced to improve color purity and provide high resolution.

What is claimed is:

1. A color picture tube comprising a shadow mask of a precipitation strengthening Fe-Ni alloy which contains Fe-Ni as a major constituent and has at least one additive element, which additive element forms precipitation strengthening phase of $Ni_xX_y$ (wherein X is at least one element selected from the group consisting of Al, Ti, Nb, Ta and Zr; x is 2 to 4; and y is 0.5 to 1.5) and an average thermal expansion coefficient of not more than $6\times10^{-6}$/°C. in a temperature range of 20° C. to 100° C.

2. A tube according to claim 1, wherein said shadow mask contains 30 to 50 wt % of Ni and 1 to 5 wt % of Ti as said at least one additive element.

3. A tube according to claim 2, wherein said shadow mask contains 30 to 50 wt % of Ni, 1 to 5 wt % of Ti as an additive element, and not more than a total of 10 wt % of at least one element selected from the group consisting of not more than 1 wt % of Mn, not more than 4.0 wt % of Al, not more than 10 wt % of Nb, not more than 1 wt % of Zr, not more than 10 wt % of Cr, and not more than 10 wt % of Ta.

4. A tube according to claim 1, wherein said shadow mask contains 35 to 45 wt % of Ni, 1 to 3 wt % of Ti, not more than 0.5 wt % of Al, 1 to 4 wt % of Cr, not more than 0.5 wt % of Si, and not more than 1 wt % of Mn, with the balance consisting of Fe and inevitable impurities.

5. A tube according to claim 1, wherein said shadow mask has a Vicker's hardness of not less than 180 after the precipitation strengthening treatment.

6. A tube according to claim 1, wherein not more than 10 wt % of the Ni in said shadow mask is substituted with an equal amount of Co.

7. A tube according to claim 2, wherein said 30 to 50 wt % of Ni in said shadow mask is substituted partially or entirely with an equal amount of Co.

8. A tube according to claim 3, wherein 30 to 50 wt % of Ni in said shadow mask is substituted with an equal amount of Co.

9. A tube according to claim 4, wherein 30 to 50 wt % of Ni in said shadow mask is substituted with an equal amount of Co.

* * * * *